US011318473B2

(12) United States Patent
Okuya

(10) Patent No.: US 11,318,473 B2
(45) Date of Patent: May 3, 2022

(54) BLADE PLATE FOR CRUSHER, AND CRUSHER

(71) Applicant: YUATSUKI Co., LTD, Aichi (JP)

(72) Inventor: Yasuaki Okuya, Aichi (JP)

(73) Assignee: YUATSUKI Co., LTD., Aichi (JP)

( * ) Notice: Subject to any disclaimer, the term of this patent is extended or adjusted under 35 U.S.C. 154(b) by 0 days.

(21) Appl. No.: 16/620,958

(22) PCT Filed: Aug. 22, 2017

(86) PCT No.: PCT/JP2017/030000
§ 371 (c)(1),
(2) Date: Dec. 10, 2019

(87) PCT Pub. No.: WO2019/038840
PCT Pub. Date: Feb. 28, 2019

(65) Prior Publication Data

US 2020/0197944 A1 Jun. 25, 2020

(51) Int. Cl.
*B02C 1/10* (2006.01)
*B02C 1/04* (2006.01)

(52) U.S. Cl.
CPC . *B02C 1/10* (2013.01); *B02C 1/04* (2013.01)

(58) Field of Classification Search
CPC .... B02C 1/10; B02C 1/04; B02C 7/12; B02C 15/003
USPC ..... 241/264
See application file for complete search history.

(56) References Cited

U.S. PATENT DOCUMENTS

| | | | | |
|---|---|---|---|---|
| 3,708,128 | A * | 1/1973 | Limpinsel | B02C 1/00 241/101.5 |
| 5,569,555 | A * | 10/1996 | Goldstein | H01M 6/52 429/49 |
| 6,764,036 | B2 * | 7/2004 | Okuya | B02C 1/005 241/264 |
| 7,086,620 | B2 * | 8/2006 | Okuya | B02C 1/025 241/264 |
| 8,851,407 | B2 * | 10/2014 | Okuya | B02C 1/043 241/101.73 |
| 10,086,378 | B2 * | 10/2018 | Okuya | B02C 18/04 |

FOREIGN PATENT DOCUMENTS

| | | |
|---|---|---|
| JP | 06-106083 | 4/1994 |
| JP | 09-141112 | 6/1997 |
| JP | 10-137603 | 5/1998 |

(Continued)

*Primary Examiner* — Teresa M Ekiert
*Assistant Examiner* — Teresa A Guthrie
(74) *Attorney, Agent, or Firm* — Clark & Brody LP

(57) ABSTRACT

A blade plate for a crusher, where in the blade plate is normally installed on a fixed side or a movable side, includes a base material part, and a large number of blade parts arranged on a surface of the base material part. The blade parts include a rhombic blade part that forms a rhombic blade at a corner between inclined portions and a mountain-shaped blade part that is formed in a polyhedron shape in which a cross-shaped tip blade is formed at a corner between chipped portions provided at inclined portions. An inclined blade is formed at a corner between the inclined portions and is coupled to the rhombic blade part at an intersection point of diagonals of the rhombic blade part and a crusher using the blade plate.

15 Claims, 12 Drawing Sheets

(56) References Cited

FOREIGN PATENT DOCUMENTS

| | | | | |
|---|---|---|---|---|
| JP | 2007-061691 | | 3/2007 | |
| JP | 2012-040514 | | 3/2012 | |
| JP | 2012-066253 | | 4/2012 | |
| JP | 5881881 | B1 * | 3/2016 | ..... B02C 1/10 |
| JP | 2016-209822 | | 12/2016 | |

* cited by examiner

BLADE PLATE FOR CRUSHER, AND CRUSHER

TECHNICAL FIELD

The present invention relates to a crusher blade plate (fixed blade plate, movable blade plate) and a crusher for crushing (cutting) an object to be crushed.

BACKGROUND ART

Conventionally, there is known a crusher that crushes objects to be crushed such as cast products, sprue gates, sprue runners, and weirs that are no longer necessary. When these unnecessary objects to be crushed can be finely crushed, it is convenient in storing, transporting, and processing the crushed waste material. Therefore, in order to achieve efficient crushing of the object to be crushed, the blade plate used in the crusher is particularly important. As an example of a literature related to a crusher that crushes an unnecessary object to be crushed, Patent Literature 1 below can be cited.

CITATIONS LIST

Patent Literature

Patent Literature 1 describes a "hydraulic crushing and cutting apparatus for casting weirs, sprue runners, and defective products" that includes: a fixed blade device that has a large number of mountain-shaped blades provided on a frame with open top and bottom surfaces and projecting in a staggered pattern; a swingable blade device that faces the fixed blade device and has a large number of mountain-shaped blades to mate with the mountain-shaped blades having a pivoting portion under the frame; a pressing means such as a cylinder that swings the swingable blade device; a discharge port that is provided at a lower part of the swingable blade device and the fixed blade device to discharge crushed or cut cast pieces.

Patent Literature 1: JP 6-106083 A

SUMMARY OF INVENTION

Technical Problems

However, the invention according to Patent Literature 1 is intended to crush or cut casting weirs, sprue runners, and defective products by mating with each other the mountain-shaped blades of the fixed blade device and the mountain-shaped blades of the swingable blade device facing the fixed blade device. That is, the apparatus contacts by "surface" with the target object to be crushed. Therefore, the apparatus does not contact by "blade" described later as in the present invention. Thus, stress concentration does not easily work on unnecessary casting products, and the weirs, runners, and defective products may not be finely crushed (cut).

Solutions to Problems

Therefore, an object of the present invention is to provide a blade plate for a crusher that has a rhombic blade part, a mountain-shaped blade part, and others that are arranged on a surface of a base material part to form various blade parts and that finely crushes (cuts) an object to be crushed by bringing the blade parts into "line" contact with the object to be crushed to cause stress concentration on the object to be crushed as an unnecessary casting product (in particular, an aluminum casting product or the like), and a crusher with the blade plate.

The invention is a blade plate for a crusher, including: a base material part; and a large number of blade parts arranged on a surface of the base material part. The blade parts are mountain-shaped blade parts that have a skirt portion and a tip portion. The skirt portion has a plurality of inclined portions, forms an inclined blade at a corner between the inclined portions, and has chipped portions at tip portions of the inclined portions. The tip portion has a tip blade of a substantially cross shape in a front view formed at a corner between the chipped portions, and the blade plate is installed on a fixed side or a movable side of the crusher.

The blade plate for a crusher can have the mountain-shaped blade parts arranged in a staggered pattern, and the blade plate can be installed on the fixed side or the movable side.

In another aspect of the invention, the blade plate for a crusher, includes: a base material part; and a large number of blade parts arranged on a surface of the base material part. The blade parts have a rhombic blade part and a mountain-shaped blade part. The rhombic blade part forms a rhombic blade at a corner between inclined portions. The mountain-shaped blade part has a mountain shape that includes a skirt portion and a tip portion. The skirt portion has a plurality of inclined portions, forms an inclined blade at a corner between the inclined portions, and has chipped portions at tip portions of the inclined portions. The tip portion has a tip blade of a substantially cross shape in a front view formed at a corner between the chipped portions. The mountain-shaped blade part is coupled to an apex of the rhombic blade part, and the blade plate is installed on a fixed side or a movable side.

For the blade plate for a crusher, convex blade parts having convex blades formed at a corner between the inclined portions and/or convex blade parts having an edge at a corner between the inclined portion and a belt-like portion are continuously arranged at some of the mountain-shaped blade parts in a bottom tier of the base material part, and the blade plate is installed on the fixed side or the movable side.

For the fixed blade plate for a crusher, a lower surface of the base material part has an inclined surface and a vertical surface continuous from the inclined surface, and the blade plate is installed on the fixed side.

For the movable blade plate for a crusher, the convex blade parts have one or two or more notch portions, and the blade plate is installed on the movable side.

For the movable blade plate for a crusher, small blade parts having a small blade formed at a corner between the inclined portions are provided both sides of the convex blade parts, and the blade plate is installed on the movable side.

For the blade plate for a crusher, a horizontal blade part and/or a vertical blade part is disposed above the mountain-shaped blade part arranged at a top tier of the base material part, and the blade plate is installed on the fixed side or the movable side.

For the blade plate for a crusher, an area surrounded by four sides of the rhombic blade part is set as a mating area, and the mating area is provided with a protruding blade part, and the blade plate is installed on the fixed side or the movable side.

For the blade plate for a crusher, one or more protruding blade parts are provided in a vicinity of the convex blade parts, and the blade plate is installed on the fixed side or the movable side.

For the blade plate for a crusher, one or more lower blade parts are provided in a vicinity of the convex blade parts, and the blade plate is installed on the fixed side or the movable side.

For the blade plate for a crusher, the base material part and the blade parts are made of high manganese cast steel, a bolt hole for screwing a bolt is formed on one or more of a front surface, a back surface, a flat surface, a bottom surface, and a side surface of the base material part, and the blade plate is installed on the fixed side or the movable side.

For the blade plate for a crusher, an angle θ between the inclined blades of the mountain-shaped blade parts arranged in the base material part is 90° or more, and the blade plate is installed on the fixed side or the movable side.

In another aspect of the invention, a crusher includes: a vertically opening frame that is formed from a pair of side frames arranged in parallel, a front frame that connects front sides of both the side frames, and a rear frame that connects back sides of the side frames, and has an upper opening part into which an object to be crushed is put and a lower opening part from which a crushed object is discharged; a fixed blade plate that is fixed to and supported by a holder perpendicular to or inclined from the frame; and a movable blade plate that is pivotally supported at a fulcrum shaft disposed between both the side frames, inclined from the frame at a backward movement limit position, perpendicular to the frame at a forward movement limit position, and moves forward and backward with the fulcrum shaft as a support point along with forward and backward movement of a piston rod of a cylinder provided in the rear frame. The object to be crushed is supplied into a V-shaped crushing space formed between the fixed blade plate and the movable blade plate and the movable blade plate is moved forward with respect to the fixed blade plate to crush the object to be crushed. The fixed blade plate and/or the movable blade plate is the blade plate described above and herein.

Both side frames of the crusher can have a liner with wear resistance provided inside.

The holder can be formed from an upper part and a lower part, and the lower part includes a receiving blade that has a lower discharge end extended forward and an inclined surface from upper to lower sides.

Advantageous Effects of Invention

According to the invention, the mountain-shaped blade part, the rhombic blade part, and the like are arranged on the surface of the base material part of the blade plate, and the inclined blades formed at the skirt portion and the tip blades formed at the tip portion of the mountain-shaped blade part and the rhombic blades formed at the rhombic blade part contact by "line" with the object to be crushed (in particular, an aluminum cast or the like) as a contact target. This makes it possible to cause stress concentration on the object to be crushed as an unnecessary cast product to be crushed and finely crush (cutting, fracturing, pulverizing, smashing, breaking, or the like) the object to be crushed, thereby facilitating the transportation of the object. In addition, at the time of storing the crushed waste material in the storage bucket, the crushed waste material can be inserted almost without any gap, and the density in the storage basket can be increased. This makes storage and transportation convenient, improves work efficiency, and allows the factory yard to be used widely. In addition, at the time of melting the crushed waste material with an electric furnace or the like, the waste material can be melted at a higher speed due to its thinness, thereby to suppress the power consumption (kwh) during melting and reduce the melting and working costs.

In addition, the blade parts of the fixed blade plate and the movable blade plate can contact by "line" with the object to be crushed at a plurality of positions, thereby to finely crush (cut or the like) the object to be crushed into a size of product material. This makes it possible to turn the object to be crushed into "product".

According to the invention, the convex blade parts disposed on the surface of the base material part of the blade plate, the convex blade parts having notch portions, the small blade parts on both the sides of the convex blade parts allow effective crushing (cutting or the like) of the object to be crushed and discharging of the crushed waste material by the effect of these portions alone or in synergy with one another.

According to the invention, the crushed waste material can be easily discharged by the inclined surface provided on the lower surface of the base material part of the fixed blade plate and the vertical surface continuous from the inclined surface.

According to the invention of claim 8, the horizontal blade part and/or the vertical blade part arranged on the surface of the base material part of the blade plate allow the object to be crushed to be largely divided in an effective manner and prevent the object to be crushed from escaping upward during the crushing operation.

According to the invention, the protruding blade parts in the mating area surrounded by the four sides of the rhombic blade part allow effective crushing (cutting or the like) of the object to be crushed and prevent the crushed waste material from getting caught between the blade parts.

According to the invention, the one or more protruding blade parts or lower blade parts provided in the vicinity of the convex blade part of the blade plate for a crusher installed on the fixed side or the movable side make it possible to crush (cut or the like) the waste material that has fallen downward in a more effective manner. In addition, it is possible to prevent the crushed waste material from getting caught between the blade parts and facilitate discharging of the waste materials.

According to the invention, the blade plate has the base material part and the blade parts made of high manganese cast steel with high hardness and toughness. This makes it possible to provide the blade plate that becomes work-hardened every time it is used, and has excellent wear resistance and impact wear resistance.

Conventional blade plates require maintenance in each certain period of time. However, the blade plate made of high manganese cast steel of the present invention becomes more increased in hardness and toughness as it is used, and thus is maintenance-free for about several to dozen years or longer.

In addition, the base material part of high manganese cast steel has the bolt holes, and the bolt holes become more work-hardened and increased in strength as they are used. In addition, the bolt holes will not become loosened, thereby improving the accuracy of attachment to the blade plate and performance.

Increasing the hardness of the blade plate makes it possible to lower the replacement frequency due to the longer life of the blade plate and reduce the labor required for the replacement work.

According to the invention, at the angle θ between the inclined blades of the skirt portion of the mountain-shaped blade part 90° or more, the crushed material becomes less likely to be fitted between the inclined blades. Accordingly, the object to be crushed and the crushed waste material become easy to fall.

According to the invention, it is possible to efficiently crush the object to be crushed by the crusher using the blade plate having the advantageous effects of the inventions of claims 1 to 13, and improve the operating rate of the crusher.

According to the invention, it is possible to lengthen the life time of the blade plate and the crusher with the wear-resistant liner provided inside both the side frames. Further, according to the invention, it is possible to effectively receive and crush (cutting or the like) a long object to be crushed.

DESCRIPTION OF EMBODIMENT

Figure 1:
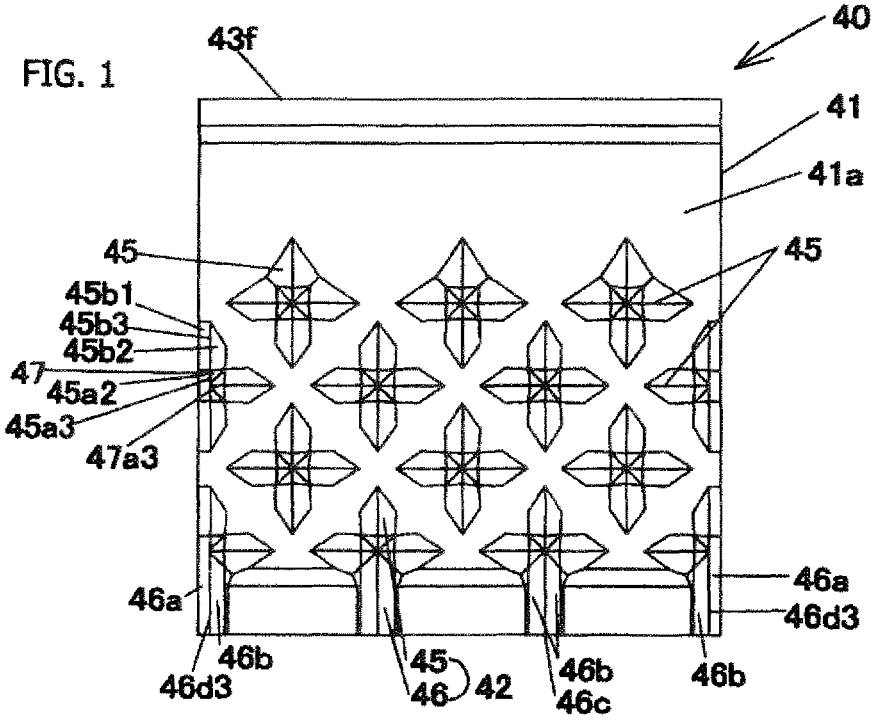
FIG. 1 is a front view of a fixed blade plate in which horizontal blade parts are arranged on a surface of a base material, mountain-shaped blade parts are arranged in a staggered pattern, and convex blade parts are continuously provided at some of the mountain-shaped blade parts in the bottom tier.

An embodiment for carrying out the present invention will be described below.

The present invention is a blade plate for a crusher Y capable of finely crushing (cutting or the like) an object to be crushed (especially an aluminum cast or the like) X such as cast products, sprue gates, sprue runners, and weirs that are no longer necessary, and the crusher Y using this blade plate. This blade plate can be divided into a fixed blade plate 40 installed on the fixed side of the crusher Y and a movable blade plate 50 installed on the movable side of the crusher Y. The blade plate crushes (cuts or the like) the object to be crushed X by a large number of blade parts 42 arranged on a surface 41*a* as a crushing surface of a base material part 41 of the fixed blade plate 40 and a large number of blade parts 52 arranged on a surface 51*a* as a crushing surface of a base material part 51 of the movable blade plate 50.

The base material parts 41 and 51 and the blade parts 42 and 52 of the blade plates are made of high manganese cast steel. The base material parts 41 and 51 of the blade plates have bolt holes 3 (female screw holes) into which bolts for attaching the blade plates are screwed.

The blade parts 42 and 52 disposed on the surfaces 41*a* and 51*a* of the base material parts 41 and 51 of the fixed blade plate 40 and the movable blade plate 50 include, as described later, mountain-shaped blade parts 45 and 55, rhombic blade parts 44 and 54, convex blade parts 46 and 56, small blade parts 58, horizontal blade parts 43*f* and 53*f* and/or vertical blade parts 43*e* and 53*e*, protruding blade parts 42*a* and 52*a*, lower blade parts 42*b* and 52*b*, and others. They can be combined in various ways. Hereinafter, the configurations and layouts of the blade parts 42 and 52 will be described in sequence. The blade parts 42 of the fixed blade plate 40 are mainly illustrated in FIGS. 1 to 5 and others, and the blade parts 52 of the movable blade plate 50 are mainly illustrated in FIGS. 6 to 14 and others. FIG. 2*b* shows a blade similar to that shown in FIG. 2*a* in terms of the use of the inclined and vertical surfaces 48 and 49 with a protruding blade part 42*a* and lower blade part 42*b*, which are respectively similar to the protruding blade part 52*a* shown in FIG. 9 and the lower blade part 52*b* shown in FIG. 10. FIG. 2*c* shows the lower blade part 42*b* on just a vertical surface similar to the lower blade part 52*b* in FIG. 10.

Figure 16:
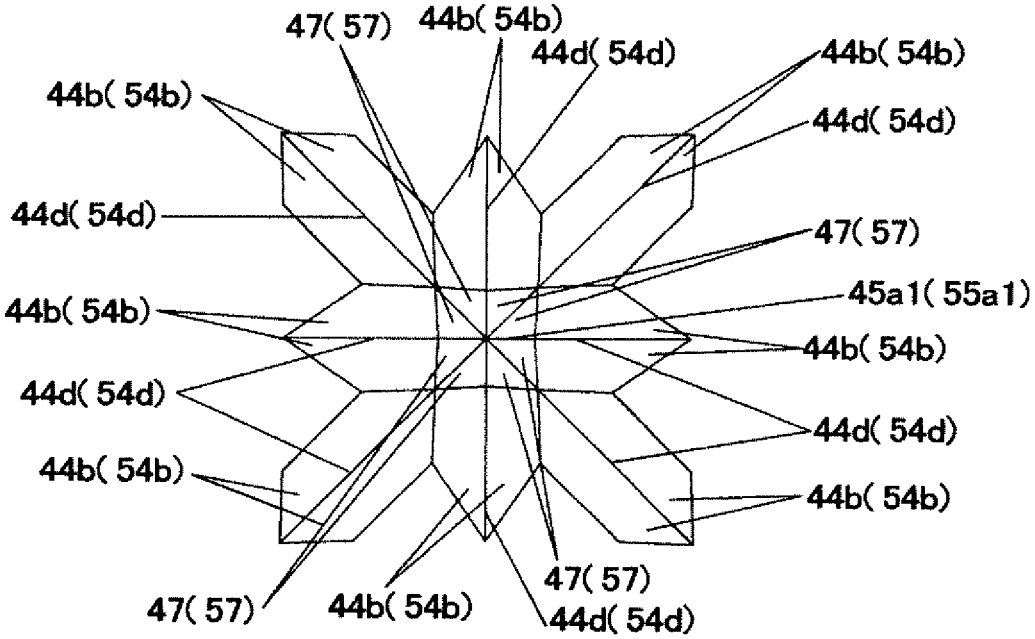
FIG. 16 is an enlarged front view of some portions of the mountain-shaped blade part and the rhombic blade part.

First, the mountain-shaped blade parts 45 will be described. The mountain-shaped blade parts 45 are substantially configured in common between the fixed blade plate 40 and the movable blade plate 50. Hereinafter, the mountain-shaped blade parts 45 of the fixed blade plate 40 will be described, and description of the mountain-shaped blade parts 55 of the movable blade plate 50 will be omitted unless there is a particular need for description. The mountain-shaped blade parts 45 are illustrated in the enlarged front view of FIG. 16 and others.

The mountain-shaped blade parts 45 are formed in a polyhedron shape by connecting four cut triangular pyramids on the surface 41*a* of the base material part 41 in a mountain shape. The mountain-shaped blade part 45 can be roughly divided into a tip portion 45*a* and a skirt portion 45*b*. In other words, the mountain-shaped blade part 45 has a divergent shape from the front side (the tip portion 45*a* side) to the rear side (the surface 41*a* side of the base material part 41). That is, the mountain-shaped blade part 45 is formed such that the height is gradually increased from the front side to the rear side.

The skirt portion 45*b* has a plurality of inclined portions 45*b*2 and forms an inclined blade 45*b*4 at a corner between these inclined portions 45*b*2. Further, each inclined portion 45*b*2 has a chipped portion 47 on a part of the tip portion 45*a* side. The tip portion 45*a* has a tip blade 45*a*1 of a substantially cross shape in a front view formed at a corner between the chipped portions 47. The inclined blades 45*b*4 and the tip blade 45*a*1 are configured such that one end of each inclined blade 45*b*4 and one end of the cross-shaped tip blade 45*a*1 are connected.

Figure 5:
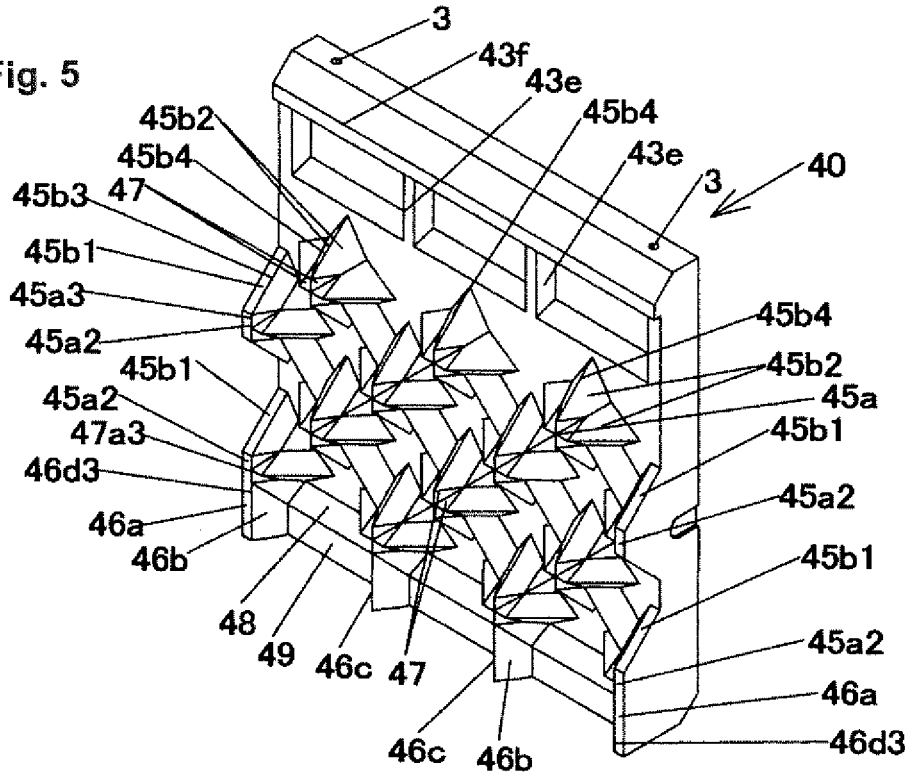
FIG. 5 is a perspective view of FIG. 2*a*.

As illustrated in FIG. 5 and others, the chipped portions 47 are inclined, and more specifically, a substantially triangular inclined surface is formed on a part of each inclined portion 45*b*2 on the tip portion 45*a* side. The chipped portions 47 may be substantially triangular inclined surfaces, or may be substantially quadrangular or hemispherical inclined surfaces. Further, the chipped portions 47 may be vertical surfaces instead of the inclined surfaces. The chipped portions 47 can be configured in any manner as far as the chipped portions 47 form the tip blades 45*a*1 so that stress is likely to concentrate on the object to be crushed X and the object to be crushed X can be more efficiently crushed (cut or the like).

In this way, the object to be crushed X can be finely crushed (cut or the like) by the cross-shaped tip blades 45*a*1 formed at the corners between the chipped portions 47 and the inclined blades 45*b*4 formed at the corners between the inclined portions 45*b*2.

Figure 2A:
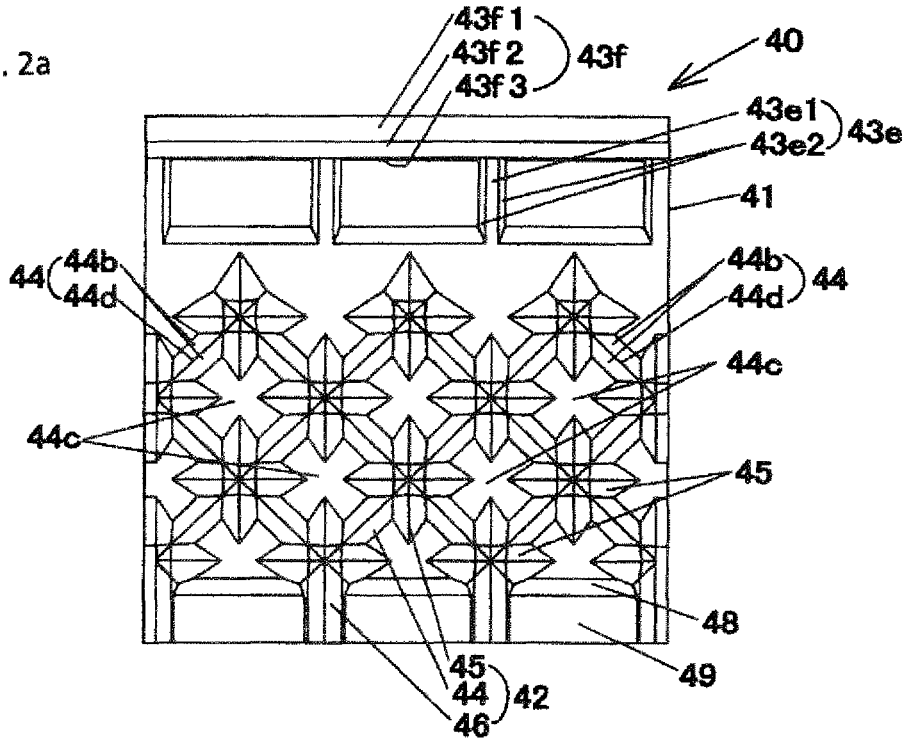
FIGS. 2*a*-2*c* are front views of a fixed blade plate in which horizontal blade parts and vertical blade parts are arranged on a surface of a base material, mountain-shaped blade parts are arranged in a staggered pattern at apexes of rhombic blade parts, and convex blade parts are continuously provided at some of the mountain-shaped blade parts in the bottom tier.
Figure 3:
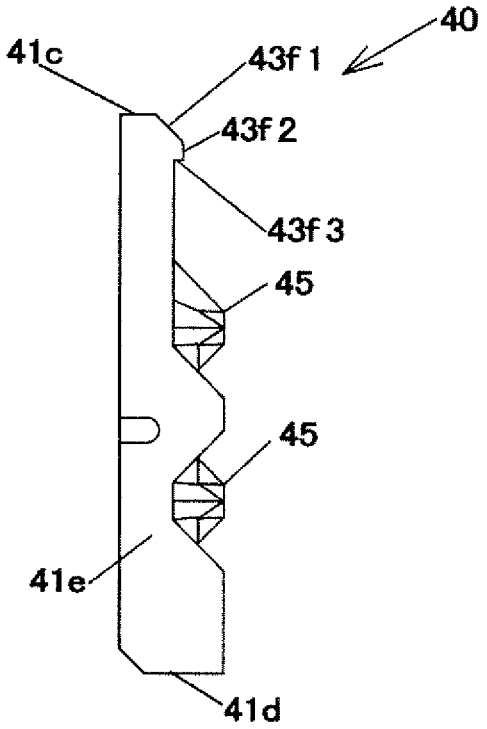
FIG. 3 is a side view of FIG. 2*a*.
Figure 4:
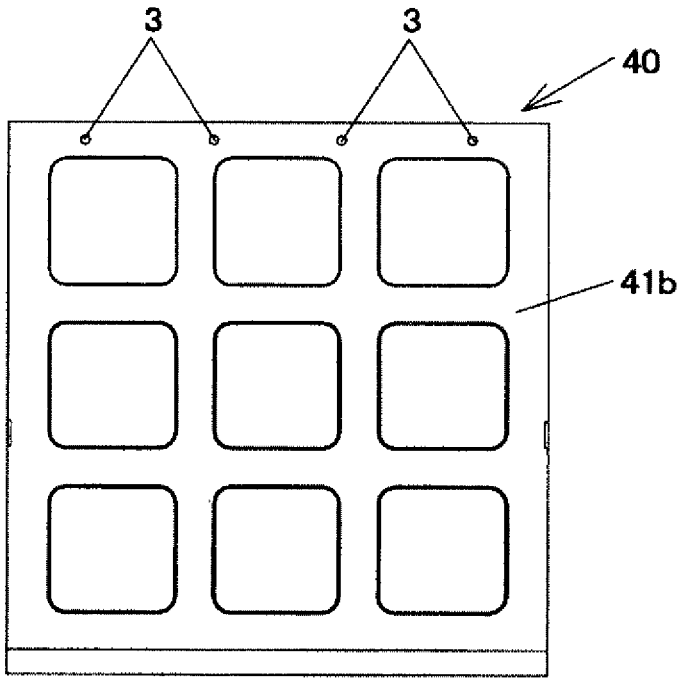
FIG. 4 is a rear view of FIG. 2*a*.

The mountain-shaped blade parts 45 disposed on the surface 41*a* of the base material part 41 of the fixed blade plate 40 can be divided into, for example, top, second, third, and bottom tiers in order from the top. However, the number of tiers can be more or less as far as the advantageous effects of the present invention can be achieved. As for the layout, the mountain-shaped blade parts 45 may be arranged in alignment or may be arranged in a staggered pattern as shown in FIG. 2*a*. Referring to FIG. 3, the mountain-shaped blade parts 45 are connected to the apexes of the rhombic blade parts 44 and are arranged in a staggered pattern.

Figure 2B:
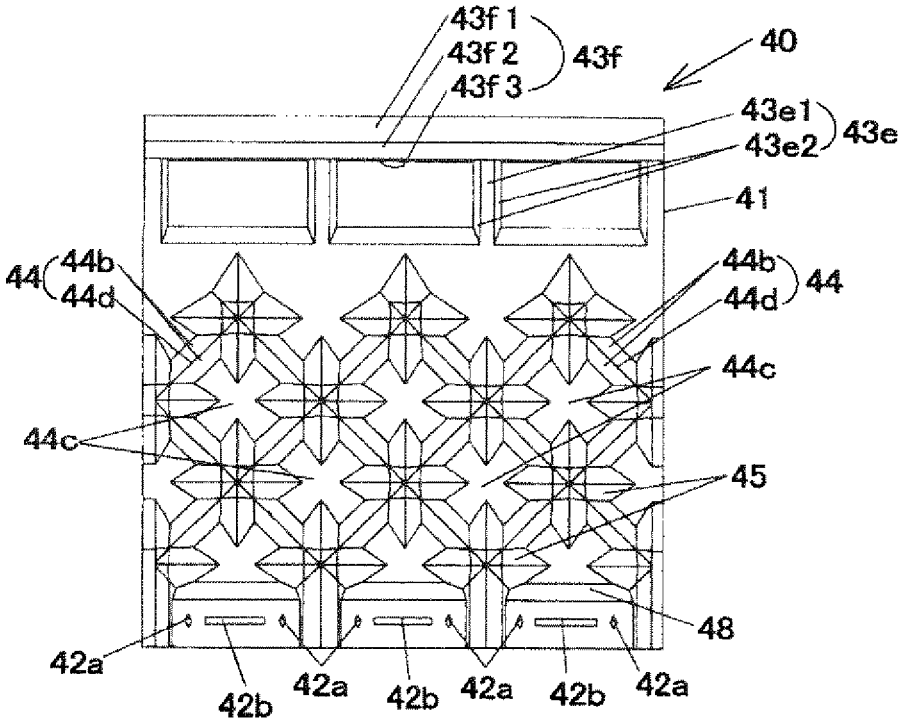
Figure 2C:
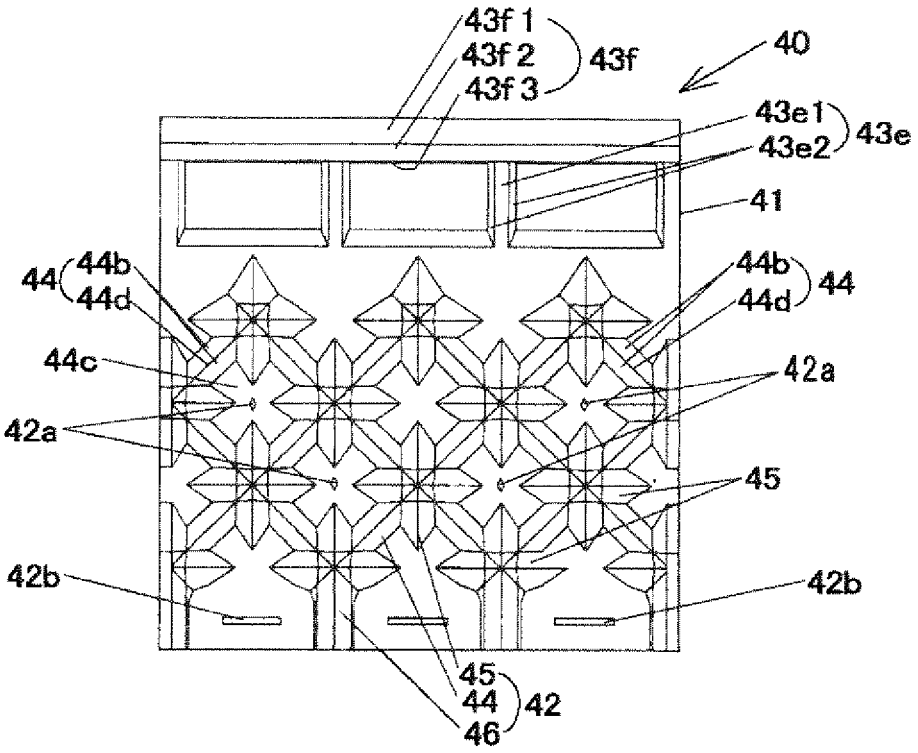

Referring to FIG. 1 and others illustrating the fixed blade plate 40, the mountain-shaped blade parts 45 at the right and left ends are half-cut in the second and bottom tiers. The half-cut mountain-shaped blade parts 45 have an inclined belt-like portion 45*b*1 at the skirt portion 45*b*, and forms an edge 45*b*3 at a corner between the inclined belt-like portion 45*b*1 and the inclined portion 45*b*2. The mountain-shaped blade parts 45 further has a tip belt-like portion 45*a*2 at the tip portion 45*a*, and forms an edge 45*a*3 at a corner between the tip belt-like portion 45*a*2 and the chipped portion 47 on the tip portion 45*a* side, and forms an edge 47*a*3 at the corner between the chipped portions 47 on the tip portion 45*a* side. Thus, with the inclined belt-like portions 45*b*1 at the skirt portions 45*b*, the strength of the half-cut mountain-shaped blade parts 45 can be maintained.

Figure 6:
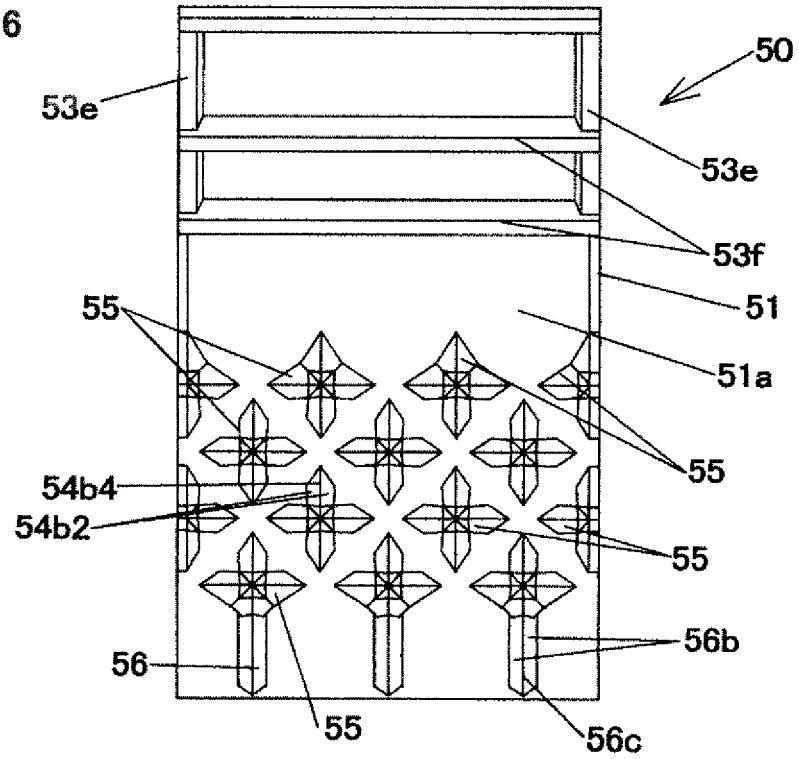
FIG. 6 is a front view of a movable blade plate in which horizontal blade parts and vertical blade parts are arranged on a surface of a base material, mountain-shaped blade parts are arranged in a staggered pattern, and convex blade parts are continuously provided at some of the mountain-shaped blade parts in the bottom tier.

Referring to FIG. 6 and others illustrating the movable blade plate 50, the mountain-shaped blade parts 55 at the right and left ends in a front view are half-cut in the first and third tiers. The half-cut mountain-shaped blade parts 55 have an inclined belt-like portion 55*b*1 at the skirt portion 55*b*, and forms an edge 55*b*3 at a corner between the inclined belt-like portion 55*b*1 and the inclined portion 55*b*2. The mountain-shaped blade parts 55 further have a tip belt-like portion 55*a*2 at the tip portion 55*a*, and forms an edge 55*a*3 at a corner between the tip belt-like portion 55*a*2 and the chipped portion 57 on the tip portion 55*a* side, and forms an edge 57*a*3 at the corner between the chipped portions 57 on the tip portion 55*a* side. Thus, with the inclined belt-like portions 55*b*1 at the skirt portions 55*b*, the strength of the half-cut mountain-shaped blade parts 55 can be maintained.

In the above description, the mountain-shaped blade parts 45 are half-cut in the second and bottom tiers of the fixed blade plate 40 and in the first and third tiers of the movable blade plate 50. However, the tiers in which the mountain-shaped blade parts are half-cut are not limited to these tiers.

Figure 15:
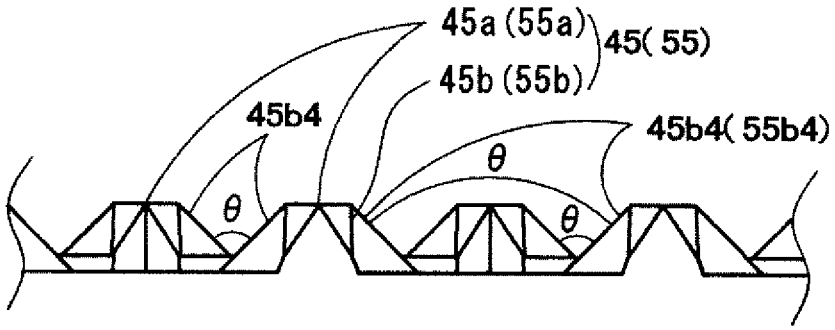
FIG. 15 is a plan view illustrating the relationship between mountain-shaped blade parts.

In addition, as illustrated in FIG. 15, by setting the angle θ between the inclined blades 45*b*4 and 55*b*4 of the adjacent mountain-shaped blade parts 45 and 55 to 90° or more, the object to be crushed X (crashed waste material) becomes unlikely to be caught between the mountain-shaped blade parts 45, and the object to be crushed X (crushed waste material) is likely to slip and fall off from between the mountain-shaped blade parts 45.

Next, the rhombic blade parts 44 will be described. The rhombic blade parts 44 are substantially configured in common between the fixed blade plate 40 and the movable blade plate 50. Hereinafter, the rhombic blade parts 44 of the fixed blade plate 40 will be described, and description of the rhombic blade parts 54 of the movable blade plate 50 will be omitted.

Each of the rhombic blade parts 44 is arranged in a rhombic shape formed by aligning their sides on the surface 41*a* of the base material part 41. As for the configuration and shape of the sides of the rhombus of the rhombic blade part 44, a rhombic blade 44*d* is formed at a corner between two inclined portions 44*b* in a substantially triangular shape in a cross-section view. The object to be crushed X can be finely crushed (cut or the like) by these rhombic blades 44*d*.

As for the positional relationship between the rhombic blade parts 44 and the mountain-shaped blade parts 45, the mountain-shaped blade parts 45 are coupled to the apexes of the rhombic blade parts 44 as illustrated in FIG. 2*a*. As for the relationship in height between the rhombic blade parts 44 and the mountain-shaped blade parts 45, the mountain-shaped blade parts 45 are higher than the rhombic blade parts 44. Specifically, in a side view, the rhombic blades 44*d* of the rhombic blade parts 44 are arranged in the middle of the skirt portions 45*b* of the mountain-shaped blade parts 45. There are no particular limitations on the numbers and sizes of the rhombic blade parts 44 and the mountain-shaped blade parts 45 as far as the advantageous effects of the present invention can be achieved.

The convex blade parts 46 will be described. As for the configuration and shape of the convex blade parts 46 of the fixed blade plate 40, a convex blade 46*c* is formed at a corner between two inclined portions 46*b* in a substantially triangular shape in a cross-section view. The convex blades 46*c* can finely crush (cut or the like) the object to be crushed X, and are particularly effective for crushing (cutting or the like) the object to be crushed X near the discharge port of the crusher Y. The convex blade parts 46 of the fixed blade plate 40 are formed in a substantially vertical shape, as is apparent from a side view.

As for the layout of the convex blade parts 46 in the fixed blade plate 40, the convex blade parts 46 are connected and integrated in part of the mountain-shaped blade parts 45 in the bottom tier of the base material part 41.

As described above, in the fixed blade plate 40, the mountain-shaped blade parts 45 at the right and left ends are half-cut in the bottom tier. As for the positional relationship between the half-cut mountain-shaped blade part 45 and the convex blade part 46, the inclined belt-like portion 45*b*1 and the tip belt-like portion 45*a*2 of the mountain-shaped blade part 45 and the belt-like portion 46*a* of the convex blade part 46 are vertically connected in line. The fixed blade plate 40 has a substantially vertical shape in a side view from the tip belt-like portion 45*a*2 to the belt-like portion 46*a* of the convex blade part 46. The fixed blade plate 40 has an edge 46*d*3 formed at the corner between the belt-like portion 46*a* of the convex blade part 46 and the inclined portion 46*b* of the convex blade part 46.

Figure 7:
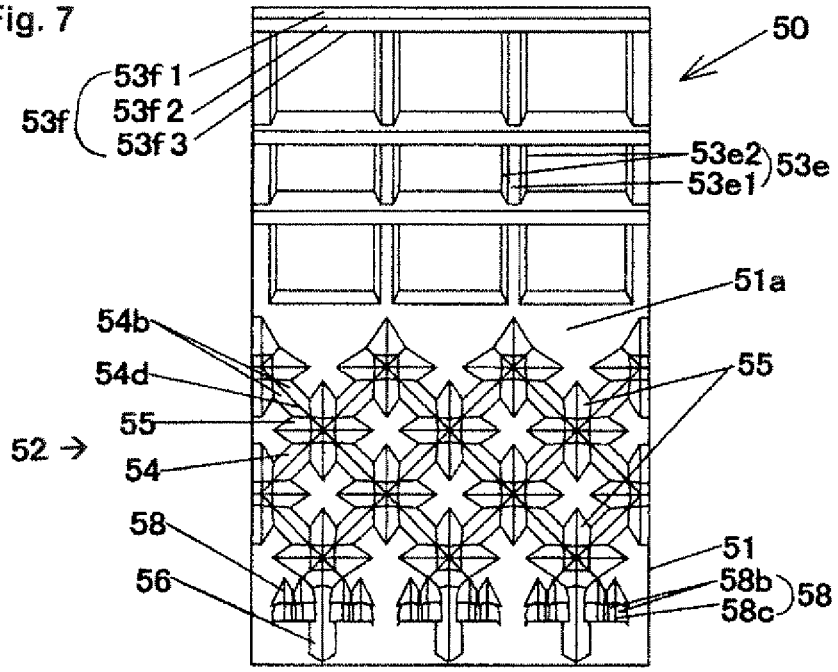
FIG. 7 is a front view of a movable blade plate in which horizontal blade parts and vertical blade parts are arranged on a surface of a base material, mountain-shaped blade parts are arranged in a staggered pattern at apexes of rhombic blade parts, convex blade parts are continuously provided at some of the mountain-shaped blade parts in the bottom tier, and small blade parts are arranged on both sides of the convex blade parts.
Figure 8:
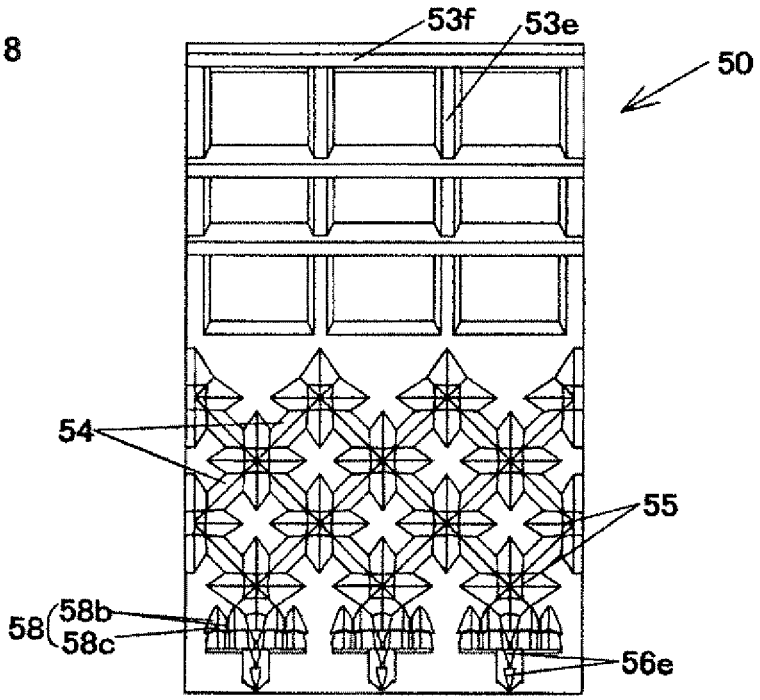
FIG. 8 is a front view of a movable blade plate having notch portions in the convex blade parts illustrated in FIG. 7.
Figure 9:
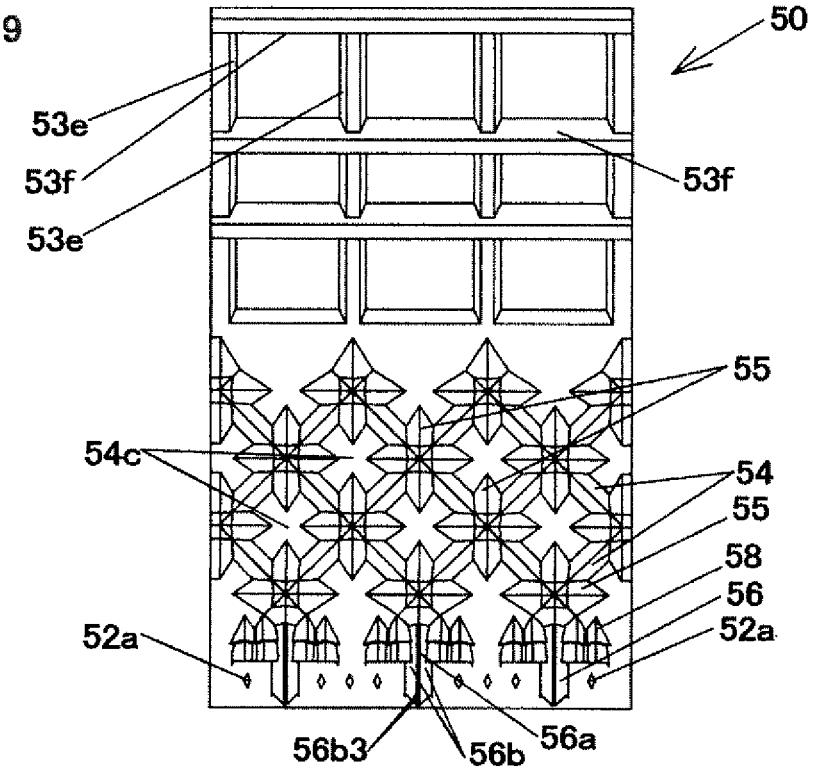
FIG. 9 is a front view of a movable blade plate having a plurality of protruding blade parts in the vicinity of the convex blade parts illustrated in FIG. 7

As for the configuration and shape of the convex blade parts 56 of the movable blade plate 50, in the same manner as with the convex blade parts 46 of the fixed blade plate 40, a convex blade 56*c* is formed at the corner between two inclined portions 56*b* in a substantially triangular shape in a cross-section view. The convex blades 56*c* can finely crush (cut or the like) the object to be crushed X, and are particularly effective for crushing (cutting or the like) the object to be crushed X near the discharge port of the crusher Y. As shown in FIGS. 6 and 7, instead of forming the convex blades 56*c* at the corner between the inclined portions 56*b*, a belt-like portion 56*a* may be provided as shown in FIG. 9, the inclined portions 56*b* may be provided on both sides of the belt-like portion 56*a*, and the edge 56*b*3 may be formed at the corners between the belt-like portion 56*a* and the inclined portion 56*b*.

As for the layout of the convex blade parts 56 in the movable blade plate 50, the convex blade parts 56 are arranged to be integrated with some portions of the mountain-shaped blade parts 55 in the bottom tier of the base material part 51.

As apparent from a side view, the convex blade parts 56 are curved from the top to the bottom. In addition, claw portions 56*d* may be formed by the lower ends of the convex blade parts 56, so that the claw portions 56*d* can hook the object to be crushed X and crush and scrape reliably and efficiently.

Figure 10:
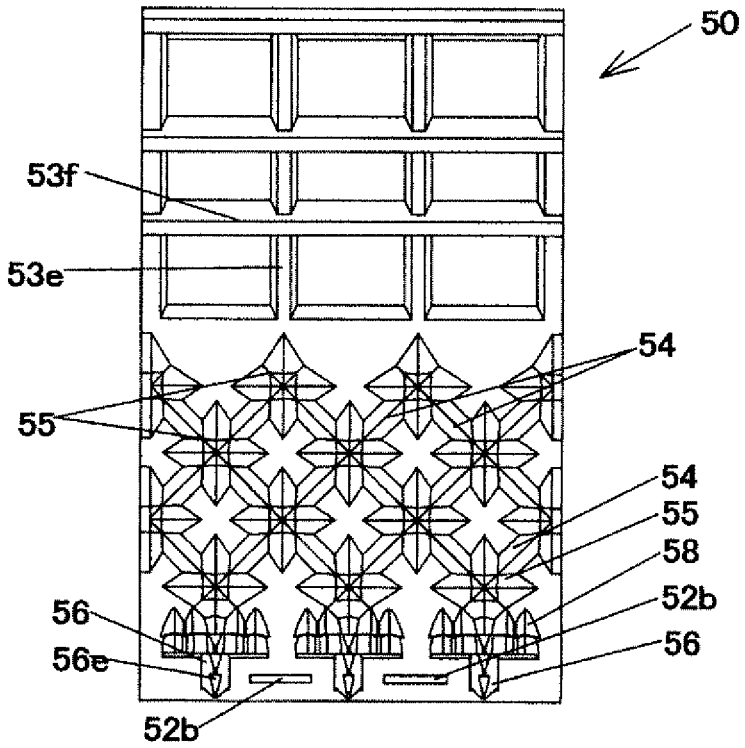
FIG. 10 is a front view of a movable blade plate having a plurality of lower blade parts in the vicinity of the convex blade parts illustrated in FIG. 7.

Further, as shown in FIG. 10, one or more notch portions 56*e* may be added into the convex blade parts 56. According to this structure, it is possible to crush and scrape the object to be crushed more reliably and efficiently.

The small blade parts 58 will be described. FIG. 7 and the like show a configuration in which the small blade parts 58 of a substantially triangular shape in a cross-sectional view are vertically arranged on both sides of the convex blade parts 56 of the movable blade plate 50. Each of the small blade parts 58 has two inclined portions 58*b*, and a small blade 58*c* is formed at the corner between these inclined portions 58*b*. The object to be crushed X can be finely crushed (cut or the like) by these small blades 58*c*. As illustrated in FIG. 7 and others, the small blade parts 58 may be disposed in contact with the inclined portions 56*b* of the convex blade part 56, or may be disposed not in contact with the inclined portions 56*b*. Although not shown, the fixed blade plate 40 can also be provided with small blade parts.

The small blade parts 58 are curved as is apparent in a side view. Referring to FIG. 7 and others, two rows of small blade parts 58 are vertically connected in parallel on both sides of the convex blade parts 56. However, the small blade parts may be arbitrarily configured and arranged. For example, the small blade parts 58 may be provided on both sides of the convex blade parts 56 without being vertically connected. Further, the small blade parts 58 have the claw portions 58*d* that can crush the object to be crushed X and scrape the object to be crushed X more reliably and effectively.

Furthermore, as illustrated in FIGS. 9, 10, and others, providing a plurality of protruding blade parts 52*a* in the vicinity of the convex blade parts 56, for example, below the small blade parts 58, or providing the lower blade part 52*b* in the lateral direction and/or the vertical direction makes it possible to crush (cut or the like) and scrape the object to be crushed X reliably and efficiently.

Further, as is apparent from FIGS. 1, 2*a*, 5, and others, to facilitate the discharge of the crushed waste material, an inclined surface 48 and a vertical surface 49 continuous from the inclined surface 48 are provided on the lower surface 41*a* of the base material part 41 of the fixed blade plate 40. The inclination angle of the inclined surface 48 is not particularly limited.

The horizontal blade part 43*f* and/or the vertical blade part 43*e* will be described. As shown in FIGS. 1 and 6, the horizontal blade part 43*f* and/or the vertical blade part 43*e* are arranged above the mountain-shaped blade parts 45, 55 in the top tier of the base material part 41, 51 of the fixed blade plate 40 or the movable blade plate 50.

The horizontal blade part 43*f* can be mainly divided into an inclined surface 43*f*1, a vertical surface 43*f*2 continuous from the inclined surface 43*f*1, and a horizontal surface 43*f*3 continuous from the vertical surface 43*f*2. Further, the vertical blade part 43*e* can be divided into a vertical surface 43*e*1 and inclined surface 43*e*2 continuous from both sides of the vertical surface 43*e*1.

The horizontal blade part 43*f* and the vertical blade part 43*e* are desirably formed in combination, for example, the vertical blade part 43*e* and the horizontal blade part 43*f* are combined in a lattice shape as shown in FIGS. 2*a*, 7, and others. In addition, only the horizontal blade part 43*f* may be arranged, or only the vertical blade part 43*e* may be arranged. In addition, a hollow may be formed on the surface 41*a* of the base material part 41 at a portion surrounded by the horizontal blade part 43*f* and the vertical blade part 43*e*.

In the fixed blade plate 40 illustrated in FIG. 2*a* and others, three openings are continuously provided in the lateral direction by a combination of the horizontal blade part 43*f* and/or the vertical blade part 43*e*. In the movable blade plate 50 illustrated in FIG. 7 and others, nine openings are continuously provided in the horizontal and lateral directions by a combination of the horizontal blade part 43*f* and/or the vertical blade part 43*e*. However, there are no particular limitations on the number, size, and others of the openings as long as the advantageous effects of the present invention can be achieved.

Figure 12:
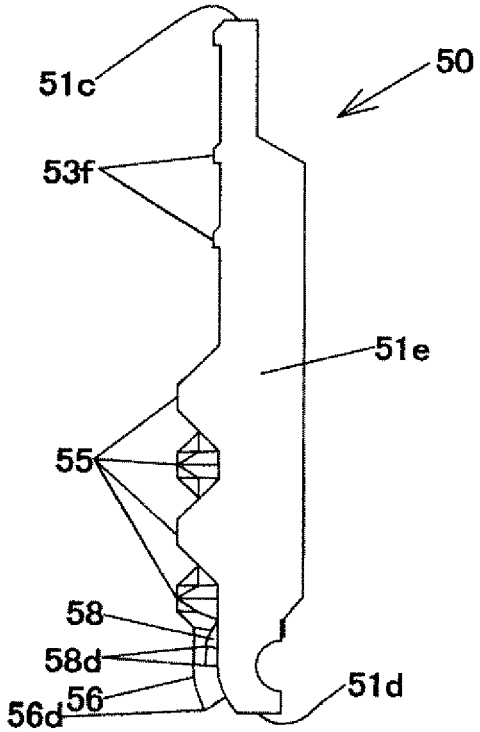
FIG. 12 is a side view of FIG. 7.
Figure 14:
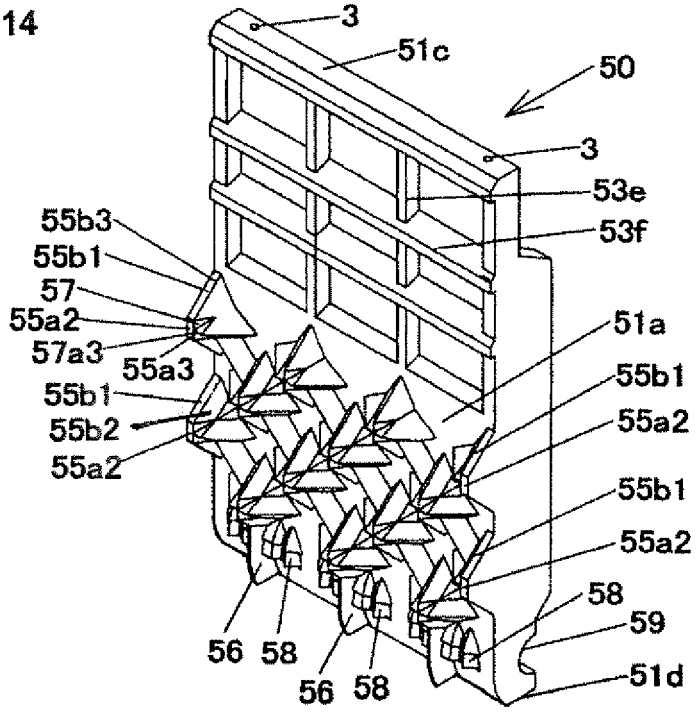
FIG. 14 is a perspective view of FIG. 7.

Referring to the perspective views of FIGS. 5 and 14, the side views of FIGS. 3 and 12, and others, the horizontal blade part 43*f* extends beyond the vertical blade part 43*e*. Otherwise, the vertical blade part 43*e* may extend beyond the horizontal blade part 43*f* or the vertical blade part 43*e* and the horizontal blade part 43*f* may extend at the same level.

Figure 18:
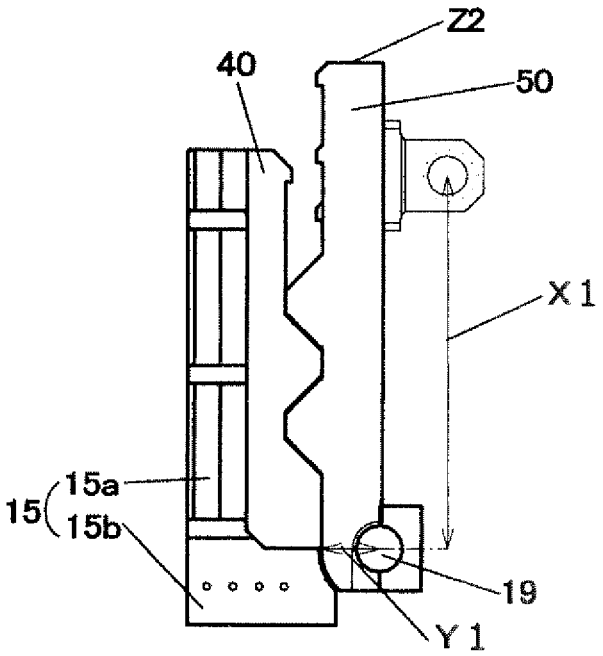
FIG. 18 is a side view of the fixed blade plate and the movable blade plate that is moved forward up to a forward movement limit position.
Figure 19:
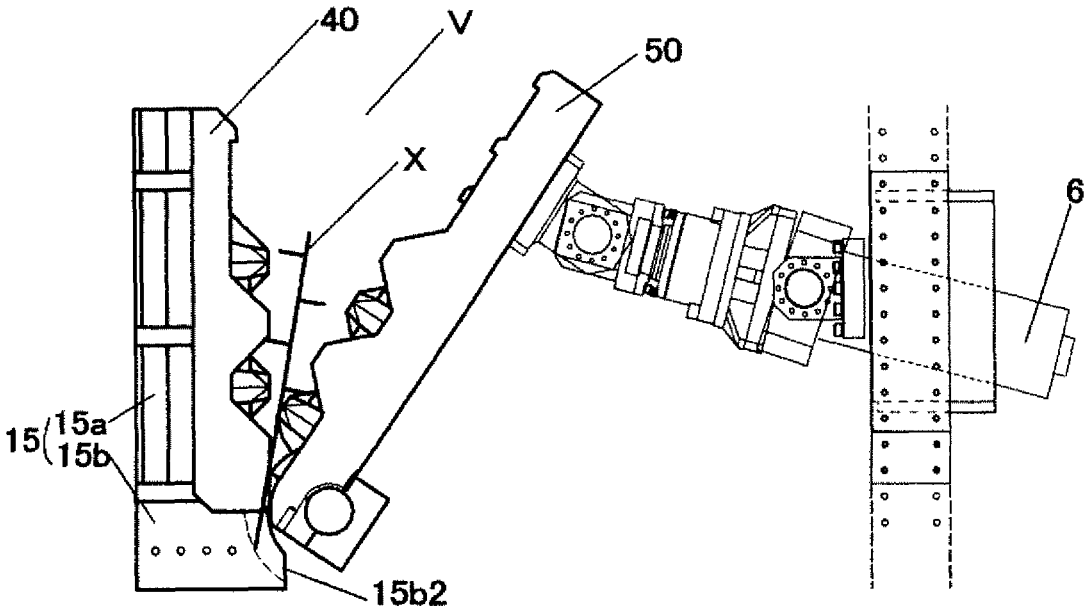
FIG. 19 is a side view of the fixed blade plate, the movable blade plate, and main components of the crusher in which an object to be crushed is caught on receiving blades.

The area surrounded by the four sides of the rhombic blade parts 44, 54 of the fixed blade plate 40, the movable blade plate 50 is set as mating area 44*e*, 54*c*. Hereinafter, an example in which the fixed blade plate 40 and the movable blade plate 50 are installed in the crusher Y described later will be described. By arranging the fixed blade plate 40 perpendicular to a frame 9 and adjusting the number of support blocks 16 to shift the position of a fulcrum shaft 19 closer to a front frame 12, when the movable blade plate 50 moves ahead toward the fixed blade plate 40 up to a forward movement limit position Z2, the fixed blade plate 40 and the movable blade plate 50 can be arranged such that the mountain-shaped blade parts 55 and 45 mate with each other in the mating areas 44*c* and 54*c*. Specifically, the mountain-shaped blade parts 55 of the movable blade plate 50 are mated in the mating area 44*c* surrounded by the four sides of the rhombic blade parts 44 of the fixed blade plate 40, and the mountain-shaped blade parts 45 of the fixed blade plate 40 are mated in the mating area 54*c* surrounded by the four sides of the rhombic blade parts 54 of the movable blade plate 50. This state is illustrated in FIG. 18.

In addition, by adjusting the number of the support blocks 16 to shift the position of the fulcrum shaft 19 closer to a rear frame 13, even when the movable blade plate 50 moves toward the fixed blade plate 40 up to the forward movement limit position Z2, the fixed blade plate 40 and the movable blade plate 50 can be arranged such that the mountain-shaped blade parts 55 and 45 do not mate with each other in the mating areas 44*c* and 54*c*. That is, depending on the adjustment of the position of the fulcrum shaft 19, when the movable blade plate 50 moves forward up to the forward movement limit position Z2, a space can be formed between the tip blade 45*a*1 of the fixed blade plate 40 and the surface 51*a* of the base material part 51 in the mating area 54*c* of the movable blade plate 50 and between the tip blade 55*a*1 of the movable blade plate 50 and the surface 41*a* of the base material part 41 in the mating area 44*c* of the fixed blade plate 40.

Figure 11:
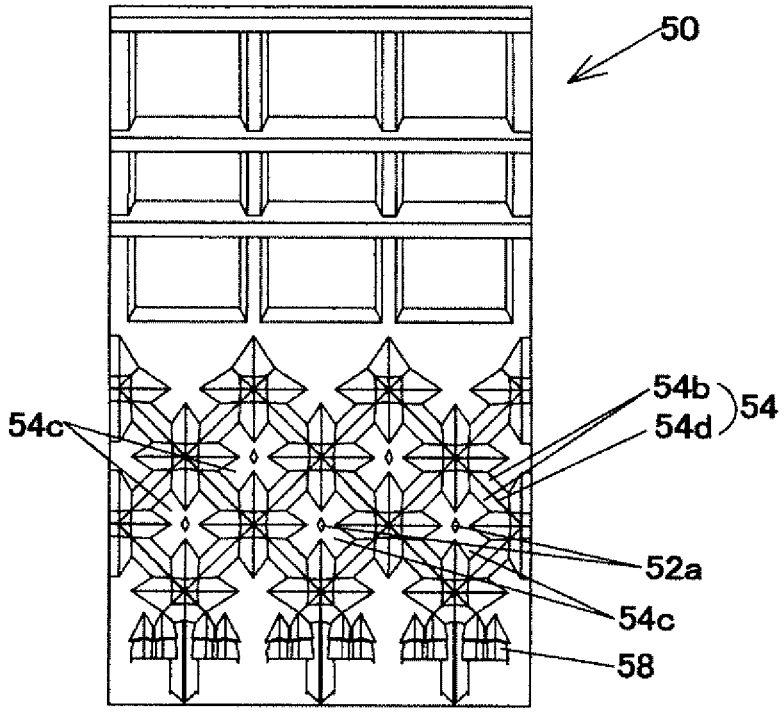
FIG. 11 is a front view of a movable blade plate having a protruding blade part in a mating area surrounded by four sides of each of the rhombic blade parts.

As shown in FIG. 11, providing the protruding blade parts 42*a*, 52*a* in the mating areas 44*e*, 54*c* surrounded by the four sides of the rhombic blade parts 44, 54 makes it possible to perform efficient crushing (cutting or the like) and prevent the crushed waste material from being caught between the blade parts.

FIG. 9 shows a configuration in which a plurality of protruding blade parts 52*a* is provided in the vicinity of the convex blade part 56 of the movable blade plate 50. FIG. 10 shows a configuration in which a plurality of lower blade parts 52*b* is provided in the vicinity of the convex blade part 56 of the movable blade plate 50. There are no particular limitations on the shapes, sizes, numbers, and others of the protruding blade parts 52*a* and the lower blade parts 52*b*, as far as they can perform effective crushing (cutting or the like), prevent the crushed waste material from becoming caught between the blade parts 50, and facilitate the scraping of the crushed waste material. Therefore, the protruding blade part 52*a* and the lower blade part 52*b* may be one each. Further, the protruding blade parts 52*a* may have a substantially triangular shape in cross-sectional view instead of the rhombic shape as illustrated in FIG. 9, and the lower blade parts 52*b* may have a wave shape instead of the rectangular shape as illustrated in FIG. 10.

Further, there are no particular limitations on the locations of the protruding blade parts 52*a* and the lower blade parts 52*b*. For example, the movable blade plate 50 may be provided in the vicinity of the convex blade parts 56, between the convex blade parts 56, below the small blade parts 58, or the like. In the fixed blade plate 40, although not shown, the protruding blade parts 42*a* and the lower blade parts 42*b* can be provided on the inclined surface 48 and/or the vertical surface 49 continuous from the inclined surface 48 in the lower surface 41*a* of the base material part 41.

Next, descriptions will be given as to a holder 15 that is perpendicular to or inclined from the frame 9 illustrated in FIG. 17 to fix and support the fixed blade plate 40.

The holder 15 includes an upper part 15*a* and a lower part 15*b*. The lower part 15*b* has a lower discharge end 15*b*2 extending forward (toward the movable blade plate 50), and a receiving blade 15*b*1 with an inclined surface like a slide from the upper to lower sides. The convex blade parts 46 of the movable blade plate 50 move along this inclined surface. There is a gap between the inclined surface and the convex blade parts 46. This gap is kept constant from the backward movement limit position Z1 to the forward movement limit position Z2 of the movable blade plate 50. Keeping the gap constant facilitates the discharge of the crushed material Y.

There is no limitation on the extension length of the lower discharge end 15*b*2 of the lower part 15*b* of the holder 15. Therefore, the lower discharge end 15*b*2 can be more extended than that illustrated in FIG. 17 and others.

The holder 15 can be a separation type in which the upper part 15*a* and the lower part 15*b* can be separated, or an integral type in which the upper part 15*a* and the lower part 15*b* cannot be separated.

When the object to be crushed X is finely crushed by the rhombic blade parts 44 and the mountain-shaped blade parts 45, the crushed waste material is discharged on the slide along the inclined surface. However, if the object to be crushed X is a long object, the long object to be crushed X becomes caught on the inclined surface like a slide and prevented from falling. Then, the object to be crushed X caught on the inclined surface is crushed by the convex blade parts 56 of the movable blade plate 50, and the crushed waste material is scraped and discharged by the convex blade parts 56 of the movable blade plate 50.

The material of the holder 15, for example, is special alloy steel or the like.

Examples of the material of the base material parts 41 and 51 and the blade parts 42 and 52 constituting the blade plates of the present invention include high manganese cast steel. Along with the use, high manganese cast steel is work-hardened such that the used portions become hardened in sequence. That is, although the initial hardness is low, it is hardened from the surface by an impact applied to the surface, and the wear resistance is greatly improved. Accordingly, the life of the blade plate is greatly increased. Specifically, the hardness after work hardening of the blade plate is HRC 40 to 50 or more.

Examples of other materials of the base material parts 41 and 51 and the blade parts 42 and 52 constituting the blade plates include special steels such as carbon steel for machine structure (SC) and alloy steel for machine structure (SCM and the like), alloy castings based on ordinary cast steel FCD, and others.

In addition, using the same material for the base material parts 41 and 51 of the blade plates and for the blade parts 42 and 52 makes it possible to, when the blade plates themselves become unnecessary, process together the base material parts 41 and 51 and the blade parts 42 and 52. This facilitates a reproduction process.

Bolt holes 3 are generally formed using a machine tool such as a commercially available machining center (not shown). For example, a tool for machining the bolt holes 3 is attached to the spindle of the machining center and is rotated to form the bolt holes 3. The bolt holes 3 are formed on one or more of the front surface 41*a*, back surface 41*b*, flat surface 41*c*, bottom surface 41*d*, and side surfaces 41*e* of the base material part 41. In addition, the bolt holes 3 can be machined with M20×2.5P, M24×3.0P, or M30×3.0P where the diameter of the bolt holes is M (mm) and the pitch of the thread is P (mm).

An example of a method for forming the bolt hole 3 is as below. Here, the fixed blade plate 40 will be taken in the following description. First, a pilot hole is made by a drill or the like at predetermined portions of the fixed blade plate 40, for example, on one or more of the front surface 41*a* as a mounting surface, the back surface 41*b*, the flat surface 41*c*, the bottom surface 41*d*, and the side surfaces 41*e* of the base material part 41. Then, a screw hole is created by forming a screw groove on the inner wall surface of the drilled pilot hole, by the use of a tap or the like.

The pilot hole is formed to have an inner diameter smaller than the outer diameter of the thread portion of the tap. The tap is rotated and inserted into the pilot hole to cut the inner wall surface of the pilot hole and form a bolt groove, thereby machining the bolt hole 3. That is, the lower screw (lower hole, inner diameter) smaller in diameter than the bolt is produced by a cutting process with a drill or the like, and the bolt hole 3 is produced by a cutting process along the lower screw. For example, in the case of forming the bolt hole 3 using a tap, first, a hole having the lower diameter (minimum diameter) of the bolt is made with a drill or the like, and then the tap is screwed into the lower hole to form the bolt hole 3.

For the machining center, a control device driving and controlling the driving means and spindle of the machining center according to a program for forming the bolt holes 3 is used. Specifically, the control device controls the position and speed of the special tool for machining the bolt holes 3 with respect to the fixed blade plate 40 and the movable blade plate 50, according to the procedure for forming the bolt holes 3 prescribed in the program for forming the bolt holes 3. In addition, the machining center controls the rotation speed of the spindle by decoding the rotation speed of the spindle motor in the program for forming the bolt holes 3, for example.

As a specific machining method, for example, a special tool (super steel threading tip or the like) is mounted on the spindle of a machining center capable of three-axis control of X axis, Y axis, and Z axis to form a female screw hole by performing the helical feeding (arc) function of the machining center.

According to this method, first, a pilot hole is made by a drill or the like at predetermined portions of the fixed blade plate 40 on one or more of the front surface 41*a* as a mounting surface, the back surface 41*b*, the flat surface 41*c*, the bottom surface 41*d*, and the side surfaces 41*e* of the base material part 41.

Then, while the spindle of the machining center equipped with the special tool (super steel thread cutting tip or the like) is rotated and helically fed in the Z-axis direction to produce the female thread groove by a cutting process on the inner peripheral surface of the pilot hole. For example, the female screw groove is formed by helically feeding the spindle with a one-pitch advance per revolution.

In addition, using a tap with a drill at the tip makes it possible to cover the formation of a pilot hole to the threading by a single tool. Specifically, a drill tap is attached to the spindle of the machining center to form the bolt hole 3.

As described above, the bolt hole 3 is machined in the fixed blade plate 40 by using the helical feed (arc) function of the machining center or the like.

Figure 13:
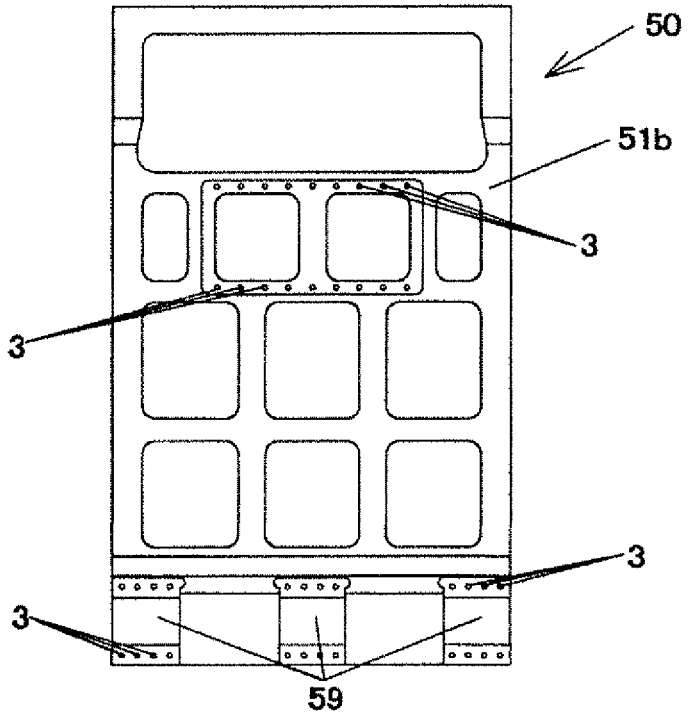
FIG. 13 is a rear view of FIG. 7.

By the same method, the bolt holes 3 are also formed in the front surface 51*a*, back surface 51*b*, flat surface 51*e*, bottom surface 51*d*, and side surface 51*e* of the movable blade plate 50. The processing method is the same as that of the fixed blade plate 40 and description thereof will be omitted. Referring to FIG. 13, the bolt holes 3 and the like for fixing to a piston rod 7 of a cylinder 6 are produced.

There are no particular limitations on the position, size, number, and others of these bolt holes 3.

Figure 17:
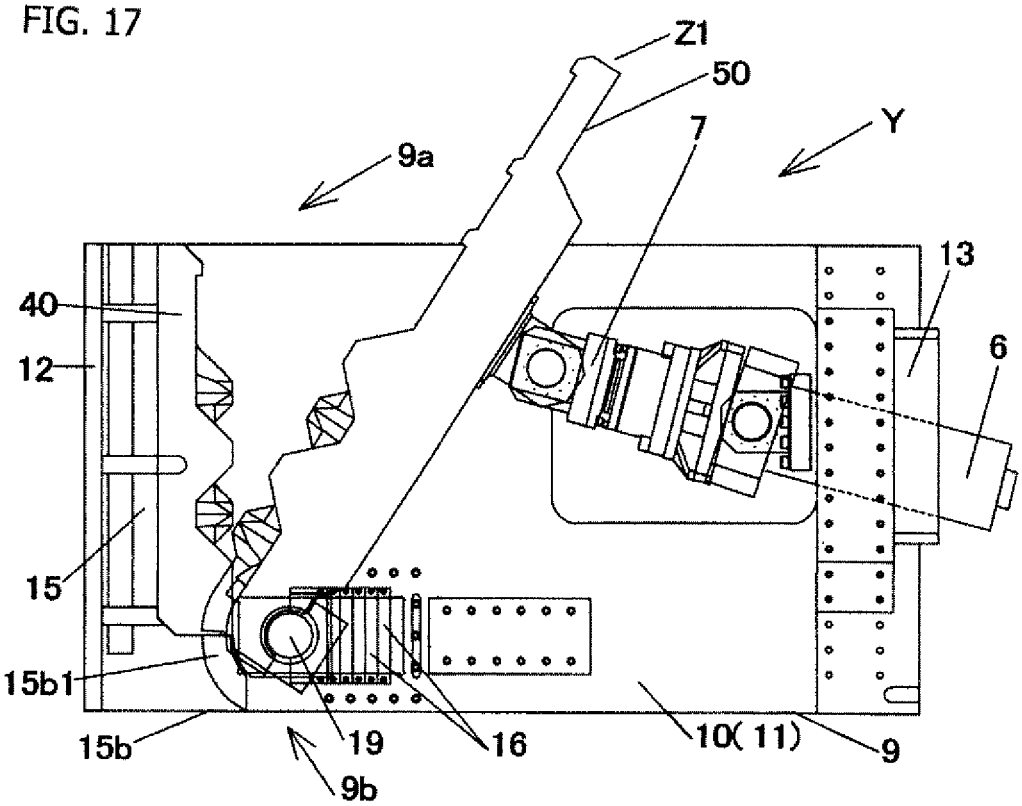
FIG. 17 is a side view of a crusher in which the fixed blade plate illustrated in FIG. 2 and the movable blade plate illustrated in FIG. 7 are installed.

Regarding the fixing of the blade plate with the bolt holes 3, for example, as illustrated in FIG. 17 and others, the holder 15 is used for the fixed blade plate 40, and the fixed blade plate 40 is attached to the holder 15. Specifically, the fixed blade plate 40 is attached to the holder 15 by forming a concave or convex portion on the fixed blade plate 40 mounting surface of the holder 15 provided in the frame 9 of the crusher Y, forming a convex or concave portion on the holder 15 mounting surface of the fixed blade plate 40, mating the concave or convex portion on the fixed blade plate 40 mating surface of the holder 15 with the convex or concave portion on the holder 15 mounting surface of the fixed blade plate 40, and inserting bolts or the like into the bolt holes 3 in the holder 15 and the fixed blade plate 40 from the holder 15 side.

Like the fixed blade plate 40 described above, the holder 15 is used for the conventional movable blade plate 50, and the movable blade plate 50 is attached to the holder 15. For example, the movable blade plate 50 is attached to the holder 15 by forming a concave or convex portion on the movable blade plate 50 mounting surface of the holder 15, forming a convex or concave portion on the holder 15 mounting surface of the movable blade plate 50, mating the concave or convex portion on the movable blade plate 50 mounting surface of the holder 15 with the convex or concave portion on the holder 15 mounting surface of the movable blade plate 50, and inserting bolts or the like into the bolt holes 3 in the holder 15 and the movable blade plate 50 from the holder 50 side. Referring to FIGS. 10 and 17, the holder 15 is not used for the movable blade plate 50, and the piston rod 7 of the cylinder 6 is fixed to the back upper surface of the movable blade plate 50. Since the piston rod 7 is fixed to the back upper surface of the movable blade plate 50 as described above, the movable blade plate 50 can be moved back and forth with a small force.

As other examples, the holder 15 may be used for both the fixed blade plate 40 and the movable blade plate 50, or the holder 15 may not be used for the fixed blade plate 40 or the movable blade 50, as long as the advantageous effects of the present invention can be produced. Furthermore, the fixed blade plate 40 having the function of the holder 15, that is, a holder and fixed blade plate cab be used.

When the holder 15 for attaching the blade (blade plate) is not used, the cost of the crusher Y as a product can be reduced, and the weight of the crusher Y can be decreased. This makes it easy to suppress the total weight of the crusher Y.

As described above, the fixed blade plate 40 and the movable blade plate 50 are attached and detached via the bolts, so that the fixed blade plate 40 and the movable blade plate 50 can be individually replaced in an easy manner.

The bolts are made of, for example, high carbon steel and can correspond to a high load and a high torque.

The blade plate of the present invention is mainly useful for crushing (cutting or breaking) hard-to-crush (hard-to-cut, hard-to-break) materials having characteristics such as hardness and thickness, for example, ductile cast iron (FCD material) and the like), and is also useful for crushing gray (ordinary) cast iron (FC material).

Next, an example of a configuration of the crusher Yin which the fixed blade plate 40 and the movable blade plate 50 are mounted will be described.

The crusher Y includes: the vertically opening frame 9 that is formed from a pair of side frames 10, 11 arranged in parallel, a front frame 12 that connects front sides of both the side frames 10, 11, and a rear frame 13 that connects back sides of the side frames 10, 11, and has an upper opening part 9*a* into which an object to be crushed X is put and a lower opening part 9*b* from which a crushed waste material is discharged; the fixed blade plate 40 that is fixed to and supported by the holder 15 perpendicular to or inclined from the frame 9; the movable blade plate 50 that is pivotally supported at the fulcrum shaft 19 disposed between both the side frames 10, 11, inclined from the frame 9 at the backward movement limit position Z1, perpendicular to the frame at the forward movement limit position Z2, and moves forward and backward with the fulcrum shaft 19 as a support point along with forward and backward movement of the piston rod 7 of the cylinder 6 provided in the rear frame 13. The object to be crushed X is supplied into a V-shaped crushing space V formed between the fixed blade plate 40 and the movable blade plate 50, and the movable blade plate 50 is moved forward with respect to the fixed blade plate 40 to crush the object to be crushed X.

As described above, the movable blade plate 50 is pivotally supported by the fulcrum shaft 19 provided between the side frames 10 and 11. More specifically, the movable blade plate 50 is pivotally supported by the fulcrum shaft 19 at a semicircular shaft support part 59 on the lower side of the movable blade plate 50. Then, the fulcrum shaft 19 is covered with a fulcrum shaft cap (not shown) and fixed to the movable blade plate 50 with a fixing tool such as a bolt.

Further, the fulcrum shaft 19 is mainly supported using a bearing, frame holes that are largely opened in both the side frames 10 and 11, and support blocks 16 that fit into the frame holes. Therefore, the position of the fulcrum shaft 19 can be changed by adjusting the number of the right and left support blocks 16 in the frame holes by utilizing the insertion and removal of the support blocks 16 into and from the frame holes. That is, when the movable blade plate 50 reaches the forward movement limit position Z2, the crushing space V between the fixed blade plate 40 and the movable blade plate 50 can be adjusted.

Further, as other configurations for changing the position of the fulcrum shaft 19, although not shown, a bearing, a metal provided in the bearing, an eccentric bush, and a stopper for securing the eccentric bush to the bearing can be used. According to this configuration, the stopper such as a bolt is moved, the eccentric bush is rotationally moved, and the position of the fulcrum shaft 19 is changed. After the position change, the eccentric bush is fixed by the stopper such as a bolt. In this way, the position of the fulcrum shaft 19 can be changed and fixed.

As illustrated in FIG. 12 and others, the convex blade parts 56 and the small blade parts 58 arranged in the base material part 51 of the movable blade plate 50 are located in the vicinity of the fulcrum shaft 19 and thus can effectively crush (cut or the like) an object.

Referring to FIG. 18, X1 represents the distance from the center of the fulcrum shaft 19 to the piston rod 7. In addition, Y1 represents the distance from the center of the fulcrum shaft 19 to the lower part of the surface 51*a* of the movable blade plate 50. Based on the principle of leverage, the distance X1 is set to 4 to 6 times the distance Y1. For this reason, even a heavy and hard object to be crushed can be crushed with a small force.

When the holder 15 to fix the fixed blade plate 40 is inclined from the frame 9, the fixed blade plate 40 to be fixed and supported by the holder 15 becomes also inclined from the frame 9. In this way, when the fixed blade plate 40 is inclined from the frame 9 and the movable blade plate 50 is in the backward movement limit position Z1, the V-shaped crushing space V can be widened between the fixed blade plate 40 and the movable blade plate 50. Accordingly, a relatively large object to be crushed X can be put into the crushing space V.

In addition, when the holder 15 to fix the fixed blade plate 40 is perpendicular to the frame 9, the fixed blade plate 40 to be fixed and supported by the holder 15 becomes also perpendicular to the frame 9. In this way, when the fixed blade plate 40 is perpendicular to the frame 9, the V-shaped crushing space V between the fixed blade plate 40 and the movable blade plate 50 is narrower than when the fixed blade plate 40 is inclined. However, when the movable blade plate 50 reaches the forward movement limit position Z2, the movable blade plate 50 and the fixed blade plate 40 face each other on the front and back sides in a substantially horizontal direction, and the crushing space between the fixed blade plate 40 and the movable blade plate 50 becomes narrower. This makes it possible to crush the object to be crushed X more finely.

FIG. 17 shows a trunnion type as an installation method of the cylinder 6, but other methods may be used. The cylinder 6 can be a fluid cylinder that uses hydraulic pressure or pneumatic pressure as a working fluid. For example, a hydraulic cylinder device constitutes a linear feed drive mechanism that moves the piston rod 7 back and forth to crush an object to be crushed that is put into between the fixed blade plate 40 and the movable blade plate 50. Therefore, the movable blade plate 50 is gradually displaced by the linear feed drive device of the hydraulic cylinder to apply a strong hydraulic pressure to the object to be crushed X, thereby crushing the object to be crushed X.

The cylinder 6 has a trunnion on the piston rod 7 side. The cylinder 6 is rotatably supported with respect to the rear frame 13 by a trunnion bearing via a trunnion shaft.

The piston rod 7 has a clevis bearing at a leading end, and a cylinder bracket is pivotally mounted via a clevis shaft. The mounting surface of the cylinder bracket is attached to the upper part of the back surface of movable blade plate 50 at a predetermined position where the bolt holes 3 are formed.

The cylinder bracket pivotally attached to the piston rod 7 is attached to the upper part of the back surface 51*b* of the movable blade plate 50. As the piston rod 7 extends and contracts, the movable blade plate 50 moves forward and backward with the fulcrum shaft 19 as a fulcrum. This forward and backward movement utilizes the principle of leverage with the fulcrum shaft 19 as a shaft fulcrum, which makes it possible to suppress the output of the cylinder 6 and move the movable blade plate 50 with relatively small power.

One or more liners can be detachably provided inside the side frames 10, 11 with stoppers such as bolts. In addition, the heads of the stoppers such as bolts can be processed by a polishing means to be substantially flush with each other.

This liner is made of a high-hardness material having wear resistance, such as cemented carbide, for example. Providing the liner on the side frames 10, 11 makes it possible to avoid the side frames 10, 11 from being shocked by the object to be crushed X. This improves the durability of the side frames 10, 11 and lengthen the life of the side frames 10, 11. Further, it is possible to avoid friction between the side frames 10, 11 and the blade plates. The liner has a hardness of, for example, about HRC50 to HRC60.

REFERENCE SIGNS LIST

3 Bolt hole
6 Cylinder

7 Piston rod
9 Frame
9*a* Upper opening part
9*b* Lower opening part
10 Side frame
11 Side frame
12 Front frame
13 Rear frame
15 Holder
15*a* Upper part
15*b* Lower part
15*b*1 Receiving blade
15*b*2 Lower discharge end
16 Support block
19 Fulcrum shaft
40 Fixed blade plate
41 Base material part
41*a* Front surface
41*b* Back surface
41*c* Flat surface
41*d* Bottom surface
41*e* Side surface
42 Blade part
42*a* Protruding blade part
42*b* Lower blade part
43*e* Vertical blade part
43*e*1 Vertical surface
43*e*2 Inclined surface
43*f* Horizontal blade part
43*f*1 Inclined surface
43*f*2 Vertical surface
43*f*3 Horizontal surface
44 Rhombic blade part
44*b* Inclined portion
44*c* Mating area
44*d* Rhombic blade
45 Mountain-shaped blade part
45*a* Tip portion
45*a*1 Tip blade
45*a*2 Tip belt-like portion
45*a*3 Edge
45*b* Skirt portion
45*b*1 Inclined belt-like portion
45*b*2 Inclined portion
45*b*3 Edge
45*b*4 Inclined blade
46 Convex blade part
46*a* Belt-like portion
46*b* Inclined portion
46*e* Convex blade
46*d*3 Edge
47 Chipped portion
47*a*3 Edge
48 Inclined surface
49 Vertical surface
50 Movable blade plate
51 Base material part
51*a* Front surface
51*b* Back surface
51*c* Flat surface
51*d* Bottom surface
51*e* Side surface
52 Blade part
52*a* Protruding blade part
52*b* Lower blade part
53*e* Vertical blade part
53*e*1 Vertical surface
53*e*2 Inclined surface
53*f* Horizontal blade part
53*f*1 Inclined surface
53*f*2 Vertical surface
53*f*3 Horizontal surface
54 Rhombic blade part
54*b* Inclined portion
54*c* Mating area
54*d* Rhombic blade
55 Mountain-shaped blade part
55*a* Tip portion
55*a*1 Tip blade
55*a*2 Tip belt-like portion
55*a*3 Edge
55*b* Skirt portion
55*b*1 Inclined belt-like portion
55*b*2 Inclined portion
55*b*3 Edge
55*b*4 Inclined blade
56 Convex blade part
56*a* Belt-like portion
56*b* Inclined portion
56*b*3 Edge
56*c* Convex blade
56*d* Claw portion
56*e* Notch portion
57 Chipped portion
57*a*3 Edge
58 Small blade part
58*b* Inclined portion
58*c* Small blade
58*d* Claw portion
59 Shaft support part
V Crushing space
X Object to be crushed
Y Crusher
Z1 Backward movement limit position
Z2 Forward movement limit position

The invention claimed is:

1. A blade plate for a crusher, comprising:

a base material part; and a number of blade parts arranged on a surface of the base material part, wherein the blade parts have a rhombic blade part and a mountain-shaped blade part, the rhombic blade part forms a rhombic blade at a corner between rhombic blade inclined portions, adjacent rhombic blade inclined portions each having an edge, each edge of the adjacent rhombic blade inclined portions meeting to form the rhombic blade between adjacent rhombic blade inclined portions the mountain-shaped blade part has a mountain shape that includes a skirt portion and a tip portion, the skirt portion has a plurality of inclined portions, adjacent inclined portions each having an edge, each edge of the adjacent inclined portions meeting to form an inclined blade between the adjacent inclined portions, and has chipped portions at tip portions of the inclined portions, the tip portion has a tip blade having a cross shape in a front view formed at a corner between the chipped portions, the tip blade being an edge formed by a meeting of edges of adjacent chipped portions, the mountain-shaped blade part is coupled to an apex of the rhombic blade part, and the blade plate is configured to be installed on a fixed side or a movable side of the crusher.

2. The blade plate for a crusher according to claim 1, wherein convex blade parts having convex blades formed at a corner between the inclined portions and/or convex blade parts having an edge at a corner between one of the inclined portions and a belt portion are continuously arranged at some of the mountain-shaped blade parts in a bottom tier of the base material part.

3. The blade plate for a crusher according to claim 1, wherein a lower surface of the base material part has an inclined surface and a vertical surface continuous from the inclined surface, and the blade plate is configured to be installed on the fixed side.

4. The blade plate for a crusher according to claim 2, wherein the convex blade parts have one or two or more notch portions, and the blade plate is configured to be installed on the movable side.

5. The blade plate for a crusher according to claim 2, wherein small blade parts having a small blade formed at a corner between the inclined portions are provided both sides of the convex blade parts, and the blade plate is configured to be installed on the movable side.

6. The blade plate for a crusher according to claim 1, wherein a horizontal blade part and/or a vertical blade part is disposed above the mountain-shaped blade part arranged at a top tier of the base material part.

7. The blade plate for a crusher according to claim 1, wherein an area surrounded by four sides of the rhombic blade part is set as a mating area, and the mating area is provided with a protruding blade part.

8. The blade plate for a crusher according to claim 2, wherein one or more protruding blade parts are provided adjacent the convex blade parts.

9. The blade plate for a crusher according to claim 2, wherein one or more lower blade parts are provided adjacent the convex blade parts.

10. The blade plate for a crusher according to claim 1, wherein the base material part and the blade parts are made of high manganese cast steel, a bolt hole for screwing a bolt is formed on one or more of a front surface, a back surface, a flat surface, a bottom surface, and a side surface of the base material part.

11. The blade plate for a crusher according to claim 1, wherein an angle θ between the inclined blades of the mountain-shaped blade parts arranged in the base material part is 90° or more.

12. A crusher comprising:

a vertically opening frame that is formed from a pair of side frames arranged in parallel, a front frame that connects front sides of both the side frames, and a rear frame that connects back sides of the side frames, and has an upper opening part into which an object to be crushed is put and a lower opening part from which a crushed object is discharged;

a fixed blade plate that is fixed to and supported by a holder perpendicular to or inclined from the vertically opening frame; and a movable blade plate that is pivotally supported at a fulcrum shaft disposed between both the side frames, inclined from the vertically opening frame at a backward movement limit position, perpendicular to the vertically opening frame at a forward movement limit position, and moves forward and backward with the fulcrum shaft as a support point along with forward and backward movement of a piston rod of a cylinder provided in the rear frame, wherein the object to be crushed is supplied into a V-shaped crushing space formed between the fixed blade plate and the movable blade plate and the movable blade plate is moved forward with respect to the fixed blade plate to crush the object to be crushed, and the fixed blade plate and/or the movable blade plate is the blade plate according to claim 1.

13. The crusher according to claim 12, wherein the both side frames further have a liner with wear resistance provided inside.

14. The crusher according to claim 12, wherein the holder is formed from an upper part and a lower part, and the lower part includes a receiving blade that has a lower discharge end extended forward and an inclined surface from upper to lower sides of the receiving blade.

15. The blade plate for a crusher according to claim 1, wherein the mountain-shaped blade parts are arranged in a staggered pattern.

* * * * *